US005659345A

United States Patent [19]

Altendorf

[11] Patent Number: 5,659,345

[45] Date of Patent: Aug. 19, 1997

[54] INK-JET PEN WITH ONE-PIECE PEN BODY

[75] Inventor: John M. Altendorf, Corvallis, Oreg.

[73] Assignee: Hewlett-Packard Company, Palo Alto, Calif.

[21] Appl. No.: 331,849

[22] Filed: Oct. 31, 1994

[51] Int. Cl.[6] ..... B41J 2/175

[52] U.S. Cl. ..... 347/87

[58] Field of Search ..... 347/87, 86, 85

[56] References Cited

U.S. PATENT DOCUMENTS

| | | | |
|---|---|---|---|
| 4,771,295 | 9/1988 | Baliu et al. | 347/87 |
| 5,448,275 | 9/1995 | Fong | 347/87 |
| 5,467,118 | 11/1995 | Gragg et al. | 347/87 |
| 5,497,178 | 3/1996 | DeFosse et al. | 347/87 |

FOREIGN PATENT DOCUMENTS

| | | | |
|---|---|---|---|
| 529879 | 3/1993 | European Pat. Off. | 347/87 |

*Primary Examiner*—N. Le
*Attorney, Agent, or Firm*—H. Brian Davis; Kevin B. Sullivan

[57] ABSTRACT

Disclosed is a novel multi-chamber ink-jet print cartridge (pen) that is formed of a main body member divided into three sections, a center section, and two side sections. Cover members are attached to this main body section to define three ink chambers. Each ink chamber contains a synthetic foam member that receives a respective one of three primary colored inks. The main body member is molded to be a single unitary part, so that the only ink-to-ink sealing interface between inks of different colors occurs at the interface between the main body member and the printhead. The main body member is formed to have a center ink pipe that extends upwardly into compressive contact with the foam member in the center chamber, and two side ink pipes that extend outwardly in a direction orthogonal to the center ink pipe into compressive contact with the foam held in the side ink chambers. The disclosed multi-chamber pen thus allows for a narrow pen body with a small printhead, yet also provides for a large volume of ink in each of the three ink chambers, without the need for a separate manifold member and the disadvantageous introduction of additional ink-to-ink interfaces.

14 Claims, 9 Drawing Sheets

FIG. 2
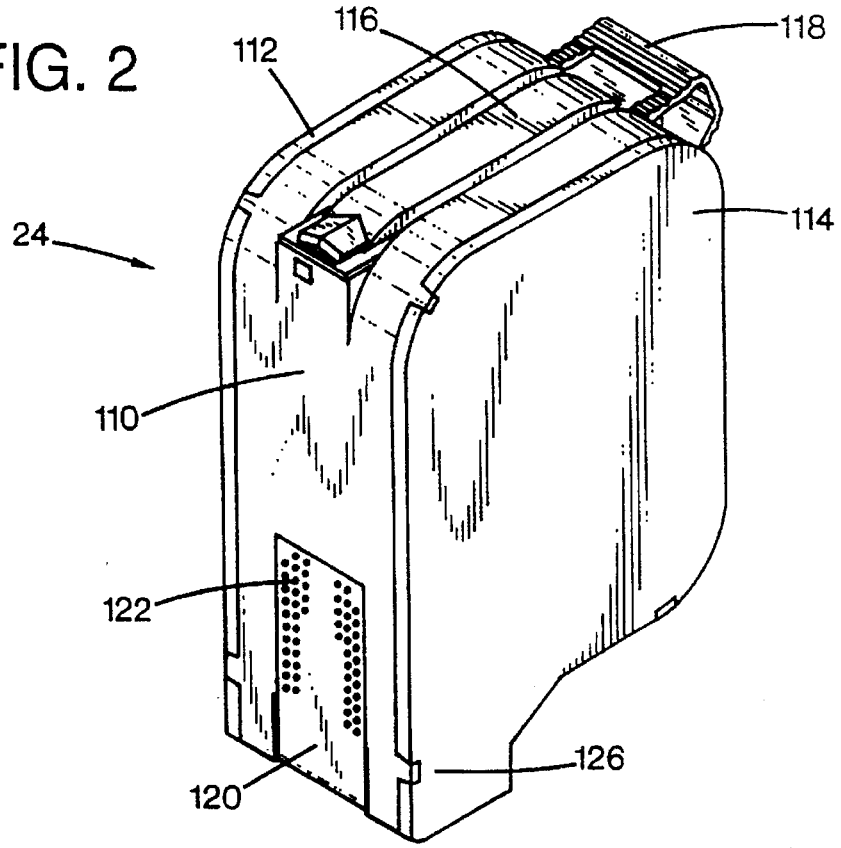
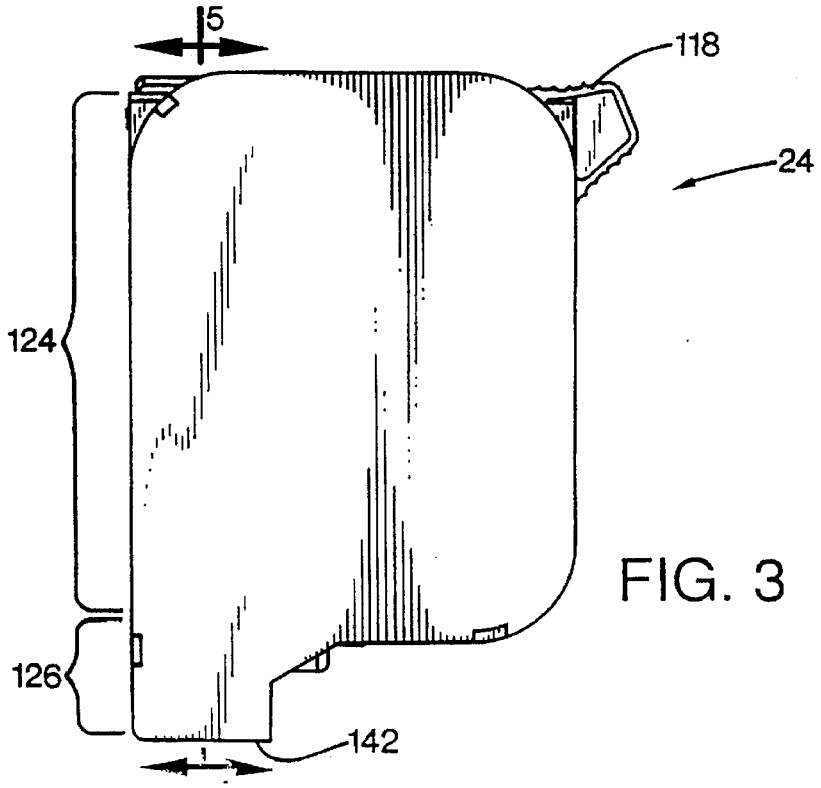
FIG. 3

INK-JET PEN WITH ONE-PIECE PEN BODY

BACKGROUND OF THE INVENTION

1. Field of the Invention

The present invention is directed to a multi-chamber ink-jet prin cartridge (pen), and more particularly to such a pen having a unitarily-formed main body member that minimizes ink-to-ink interfaces between ink colors at mating surfaces of pen body components.

2. Description of the Related Art

Ink-jet printers commonly employ ink-jet print cartridges, or "pens," which include a sophisticated printhead and an attached ink chamber filled with a supply of ink. The printhead is a micromechanical part that contains an array of miniature thermal resistors or piezoelectric transducers that are energized to eject small droplets of ink out of an associated array of nozzles. In some cases the printhead is permanently attached to the ink supply, and in others the ink supply can be separately replaced. The pen is mounted in a carriage in the printer where the pen electrically interfaces with the printer. The printer scans the pen back and forth across the print medium (e.g., paper) as the pen ejects small droplets from the nozzles in selected matrix patterns, to thereby print a swath of the desired alphanumeric characters or graphics. After each swath of printing, the printer advances the medium incrementally to begin a new swath. Successive swaths are printed in this manner to complete the desired alphanumeric characters or graphics on the medium.

The ink in the pen must be held in the ink chamber at less than atmospheric pressure, so that the ink does not drool out of the nozzles when the nozzles are not firing. However, this negative relative pressure, or backpressure, must not be so great that air is gulped into the interior of the firing chambers, thereby causing them to "deprime" and no longer function. Various mechanisms have been devised to provide the appropriate backpressure, such as resilient bladders and combinations of springs and flexible bags. One of the most reliable backpressure systems employs a porous material, such as synthetic foam, in the ink tank. The porous material receives and retains the ink at the appropriate backpressure by capillary action. The illustrated embodiments of the present invention use such porous members for ink retention.

It has become increasingly important to make ink-jet pens as narrow as possible. The overall width of the pen influences the width of the printer and the "footprint" or amount of desk space the printer takes up. On the other hand, users of printers desire that ink-jet pens last longer, in other words, that they hold more ink. Therefore, the designer of pens must deal with the competing demands of making the pens narrower, and the need to increase the volume of ink contained in the pen.

In recent years, color printing has become increasing popular. Color ink-jet printers employ three primary colors of ink, commonly in the subtractive primary colors cyan, magenta and yellow. Some ink-jet printers use four separate pens: one for black, and one each for cyan, magenta and yellow. Other printers use two pens: one pen for black and a separate three-chamber color pen for printing in color.

In multi-chamber pens, a separate group of nozzles on the printhead is dedicated to each color. Each color of ink held in the pen must be carefully ducted to its respective nozzle group on the printhead so that the colors do not mix within the pen. Pen bodies are typically are formed of plastic parts that may be assembled by, for example, ultrasonic welds or glue. Any mating surface of these parts where inks of different colors might mix must be carefully bonded so that mixing of ink does not occur.

Despite the fact that the colored inks must be kept separate, better print quality is achieved if the nozzle groups, corresponding to the different colors, are positioned close together on the printhead. This is true because as the pen is scanned across the page, if the nozzle groups are close together, less time goes by between the ejection of the different ink colors onto the page. It is also preferable that the printhead be as small as possible because they are formed of materials that are often relatively expensive compared to other portions of the pen.

A first generation of color ink-jet pens produced by Hewlett-Packard Company (HP), the assignee of the present invention, is described in U.S. Pat. No. 4,771,295 (Baker et al.). These pens (model no. 51606A) were designed for use in HP PaintJet (™) printers and have three internal bodies of foam for ink containment. In 51606A PaintJet color pens, the printhead is relatively wide, almost as wide as the entire pen body. The three chambers are mounted side-by-side in the scanning direction. The three corresponding nozzle groups are also arranged side-by-side on the printhead, with each nozzle group being generally below its respective ink chamber. This simple arrangement allows for a fairly direct ducting from the individual ink chambers directly downward to their corresponding nozzle groups. The main body member is molded as a single part, with openings for insertion of foam in the top of the pen body. There are two interfaces between pen parts. One occurs at the bond between the printhead and the pen body. The other interface occurs where the top cap of the pen seals against the pen body after the foam has been inserted.

A second generation of three-color ink-jet pens produced by Hewlett-Packard Company were designed for use in color versions of the popular HP DeskJet (™) printer. In DeskJet color pens (model no. 51625A) the printhead is much narrower than the pen body and is relatively small compared to the overall size of the pen. On the printhead, two of the nozzle groups are aligned with each other in the media-advance direction, and the other nozzle group is offset slightly in the scanning direction. The ink containment chambers are transversely oriented. In other words, rather than being mounted side-by-side in the scanning direction, they are mounted side-by-side in the media-advance direction. The small printhead size, staggered nozzle pattern, and transverse orientation of the ink chambers requires a complicated manifold structure to conduct the three ink colors from their ink chambers to their respective nozzle groups on the printhead. Because of its complicated internal structure, this manifold cannot be molded unitarily with the main body member of the pen, but is molded as a separate part and then attached to the bottom of the pen. This manifold thus adds an additional ink-to-ink interface at positions of connection between parts of the pen. One ink-to-ink interface occurs where the manifold attaches to the pen body and another occurs where the printhead mounts to the manifold. As with the PaintJet 51606A pen, another interface occurs where the top cap seals against the pen body. Not only does this manifold structure increase the possibility of intermixing of inks at interfaces, but also increases material and assembly costs. Ink-jet pens are manufactured in such high volume that such manufacturing and assembly costs are very significant.

As stated, one objective in the design of multi chamber pens is to reduce the width of the cartridge. If the ink chambers are placed side-by-side in the scanning direction, this means that the width of each ink cartridge must be correspondingly narrowed. And if the volume of ink is to increase, the dimensions of each chamber must be increased in other directions. Often the most advantageous option is to increase the size of the pen in the direction extending away from the print medium, which may be considered the height direction. However, as the width of the pen is decreased and the dimensions of the ink chambers are increased in other directions, it becomes increasingly difficult to insert foam or other ink containment devices within each ink chamber. One way of avoiding an increasingly narrow aspect ratio to each ink chamber is to transversely orient the ink chambers as is done in the 51625A DeskJet color pens. However, this option, as stated, introduces the need for a separate manifold to duct the ink from their respective chambers to the printhead.

There remains the need, therefore, for a multi-chamber ink-jet pen that minimizes the printhead size, the pen width, and the number of ink-to-ink interfaces between colors at mating parts of the pen, and yet which allows for an increased volume of ink in each ink chamber.

SUMMARY OF THE INVENTION

The invention provides a multi-chamber ink-jet pen and method providing a main body member formed unitarily as a single part. The main body member includes: a bottom wall; a center chamber extending upward from the bottom wall; two side chambers mounted on either side of the center chamber, each having an inner wall adjacent the center chamber; a center ink inlet that opens into the center chamber from the bottom wall; and two side ink inlet opens into each of the side chambers from the inner walls. A printhead is mounted on the main body member. The printhead has three nozzle groups, each of the nozzle groups being fluidically connected to a respective one of the ink inlets. A body of ink is disposed within each of the center and side chambers.

Another aspect of the invention provides a process of passing ink to a face-shooter printhead of a multi-chamber ink-jet pen. The process includes the steps of: filling ink into a center foam member having a localized increased compression provided by an ink pipe extending upwardly into compressive contact with the foam member; filling ink into side foam members, each having a localized increased compression provided by a side ink pipe extending outwardly from the direction of the center foam member into compressive contact with the side foam members; passing ink downwardly from the center foam member into the center ink pipe; passing ink inwardly from the side foam members into the side ink pipes; and passing ink downwardly from the center ink pipe and the side ink pipe foam members into nozzle groups of a face-shooter printhead.

As used herein, words such as "height," "upward," and "downward" etc. are not to be understood strictly in a gravitational or earth-centered reference frame. These words are to be understood as defined in the particular context used.

Ink-jet pens made according to the present invention solve several of the problems and offer advantages over previously known multi-color pens. Multi-chambers pens made according to the present invention may be made to contain relatively larger volumes of ink for each ink color while still providing a narrow pen body, thus allowing for smaller footprint size of the printer. These pens also allow for a small printhead, thus reducing the cost of the pen and allowing for improved print quality. Pens made according to the present invention also allow for a minimum number of sealing surfaces of pen parts where ink from one color may mix with ink from another color.

BRIEF DESCRIPTION OF THE DRAWINGS

FIG. 2 is a perspective view of a pen of the invention.

FIG. 3 is a side view of the pen of FIG. 2.

DESCRIPTION OF THE PREFERRED EMBODIMENTS

Figure 1:
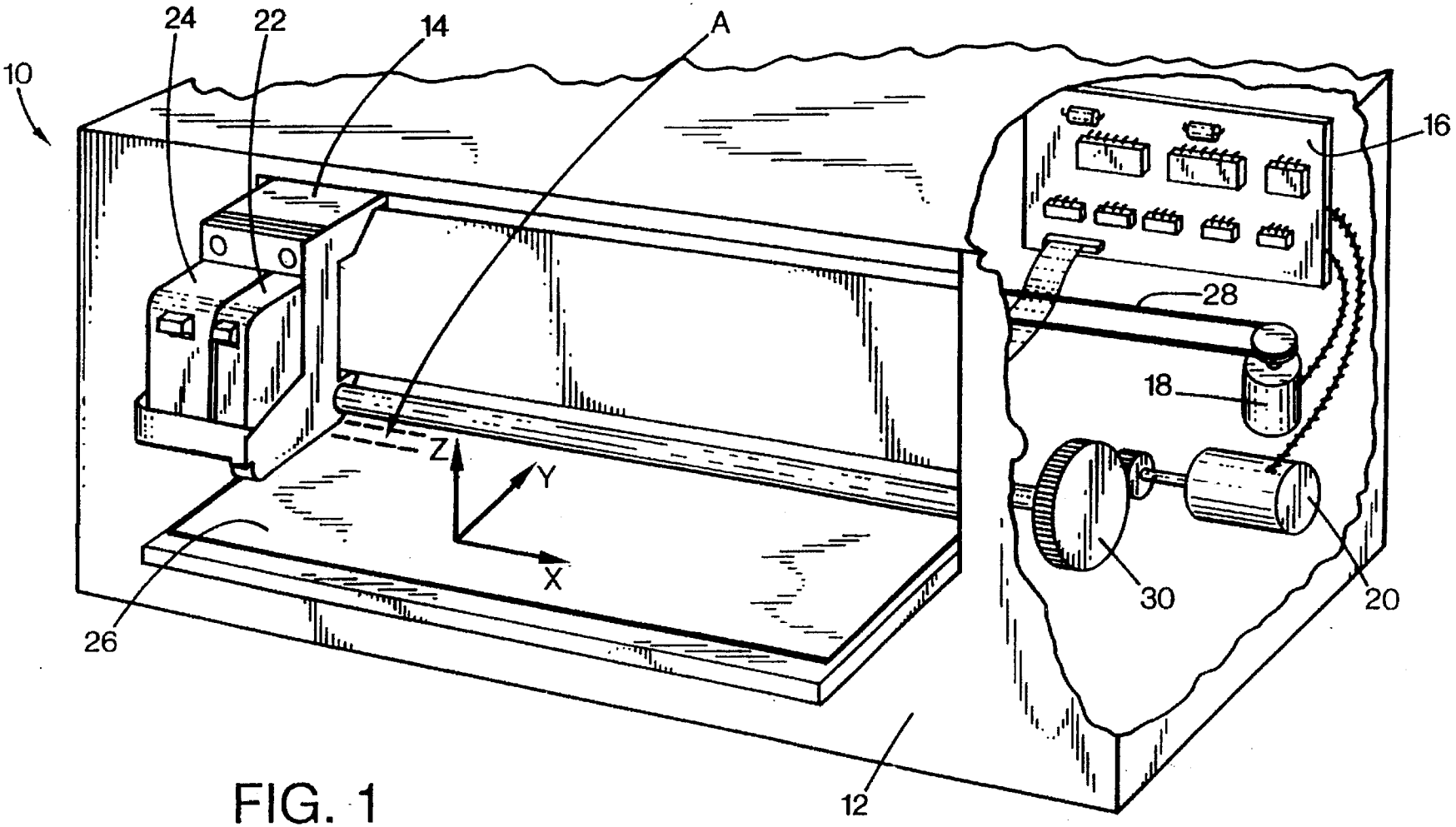
FIG. 1 is a perspective, partial cut-away, view of a printer employing an ink-jet pen of the invention.

FIG. 1 illustrates an ink-jet printer that uses a pen of the invention. The printer is illustrated only schematically, and paper input trays, paper output trays and other options are not illustrated. The printer, generally indicated at 10, includes a housing 12, carriage 14, controller 16, carriage drive motor 18 and paper drive motor 20. A monochrome black pen 22 and a multi-chamber three-color pen 24 are mounted in carriage 14 as shown. A print medium 26 is shown in printer 10 to be printed on by pens 22 and 24. Print medium 26 may be, for example, paper, transparency film, envelopes, or other print media.

Printer 10 activates pens 22 and 24 to print upon print medium 26 in a manner well known in the art, but briefly described as follows. Carriage advance motor 18 is linked to carriage 14 by means of belt 28. Controller 16 activates carriage advance motor 18 to drive carriage 14 to the right or to the left in the scanning direction as indicated by the arrow marked X. Each time carriage 14 moves to the right or to the left, the printer prints a "swath" on medium 26. Media advance motor 20 is connected to gearing mechanism 30 (schematically illustrated). Gearing mechanism 30 is connected to drive rollers and pinch rollers (not shown), which in turn directly interface with the medium 26 in a manner well known in the art.

After carriage 14 has completed one swath of printing, controller 16 activates media advance motor 20 to move the medium 26 one swath width in the direction marked Y, which is the media-advance direction. After another swath is completed, the medium 26 is advanced another swath width in direction Y so that another swath may be printed. In this manner, successive swaths are printed until all of the desired alphanumeric characters and/or graphics are printed on medium 26.

The area of medium 26 that is being primed upon may be referred to as the print zone, marked A. The print zone A may be considered to be the current swath width area that is being printed upon as carriage 14 scans across medium 26. The width of various components of pens 22 and 24 are measured in the scanning direction X. The length of components of pens 22 and 24 are measured in the media-advance direction Y. The height of pens 22 and 24 is measured in the direction marked Z, which is normal to the print medium 26 at the print zone A.

As shown in FIGS. 2 and 3, multi-chamber pen 24 includes a main body member 110, side cover members 112 and 114, center cover member 116, finger tab 118, and a flex strip 120 containing contact pads 122. The finger tab 118 is included to allow the user to more easily insert the pen 24 into the printer carriage 14 as shown in FIG. 1. The main body member 110 of pen 24 is divided mainly into two parts, the main ink cavity portieon 124 and the nose portion 126.

Figure 4:
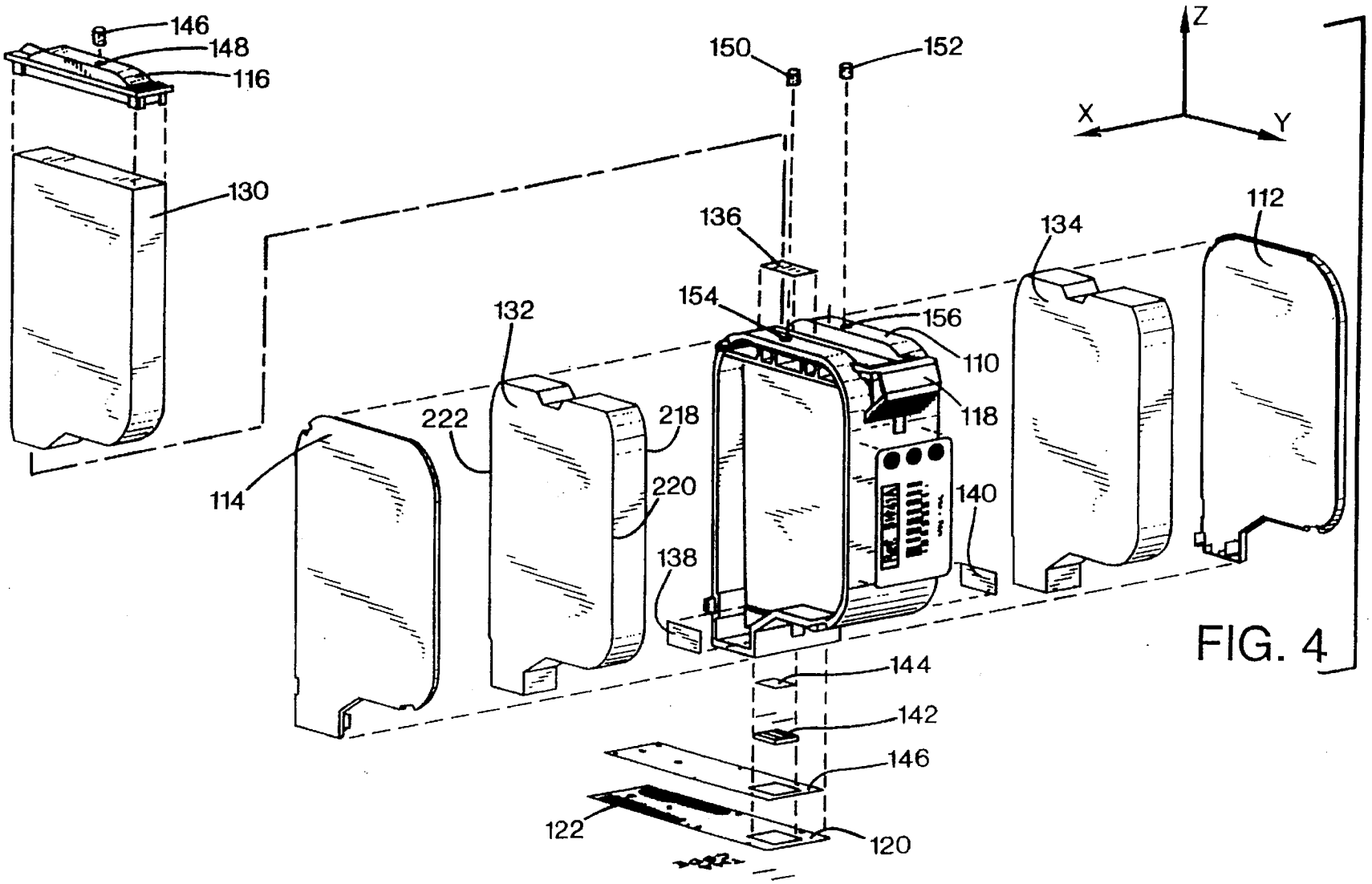
FIG. 4 is an exploded perspective view of a pen of the invention.

As shown in FIG. 4, the multi-chamber pen 24 also includes center porous member 130, side porous member 132, side porous member 134, center filter 136, side filters 138 and 140, and printhead 142. Printhead 142 is attached to main body member 110 by means of a heat curable epoxy layer 144. Flex strip 120 is heat staked to main body member 110. Flex strip 120 is a custom-made tape automated bonding (TAB) circuit formed of a polymer fill with custom designed copper traces that connect to contact pads on the printhead. An adhesive layer 146 of thermoplastic bonding film is laminated to flex strip 120 before it is heat staked to the main body member. Adhesive layer 146 melts and aids the bonding of flex strip 120 to the main body member and helps provide electrical insulation for the conductors on the flex strip. Custom-made TAB circuits are commonly available and widely used in the electronics industry. The printer into which the pen 24 is inserted interfaces with contact pads on flex strip 120 to provide the appropriate driving signals to cause the resistors on the printhead to fire at the appropriate time.

Filters 136, 138 and 140 are attached to main body member 110. A threaded nylon plug 146 is pressed into hole 148 formed in center cap 116. Likewise, threaded nylon plugs 150 and 152 are pressed into holes 154 and 156 formed in main body member 110. The helical thread pattern on these plugs provides an air path to allow the pen to breathe in air as ink is depleted from the foam members 130, 132, and 134. The long narrow channel of this helical pattern acts as barrier to vapor diffusion from the inside of the pen to the ambient environment.

Foam member 130 is inserted into center chamber 160 of main body member 110. Foam member 132 is inserted into side chamber 162, and foam member 134 is fitted into side chamber 164. Foam members 130, 132, and 134 are preferably formed of a polyether based polyurethane open cell foam without anti-oxidant. Other porous materials may also be used, such as innately reticulate thermoset melamine condensate. After the foam members are inserted into the main body member, cover members 114, 112, and center cover member 116 are ultrasonically bonded to the main body member 110 to enclose the foam members 130, 132, and 134 within the pen. Once the step of bonding cover members 112, 114, and 116 is complete, ink is injected into foam members 130, 132, and 134.

Figure 5:
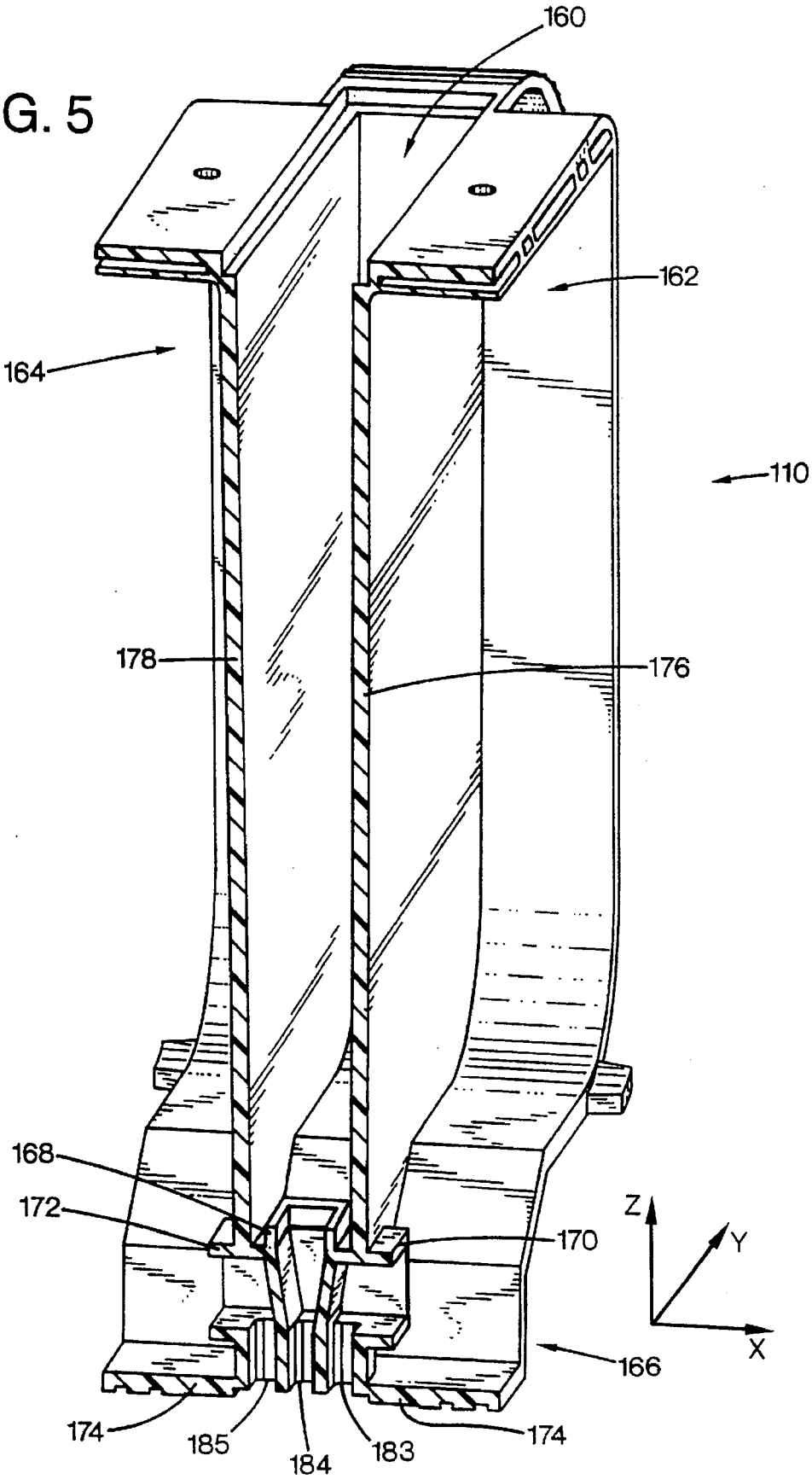
FIG. 5 is a perspective sectional view of the main body member 110 taken along section line 5—5 of FIG. 3 as viewed to the right in FIG. 3.

As shown in FIG. 5, main body member 110 is formed as a single unitary part to include the previously described center chamber 160, and side chambers 162 and 164. Main body member 110 includes a manifold section 166, which channels the ink from the ink chambers 160, 162, and 164 toward the printhead.

Figure 6:
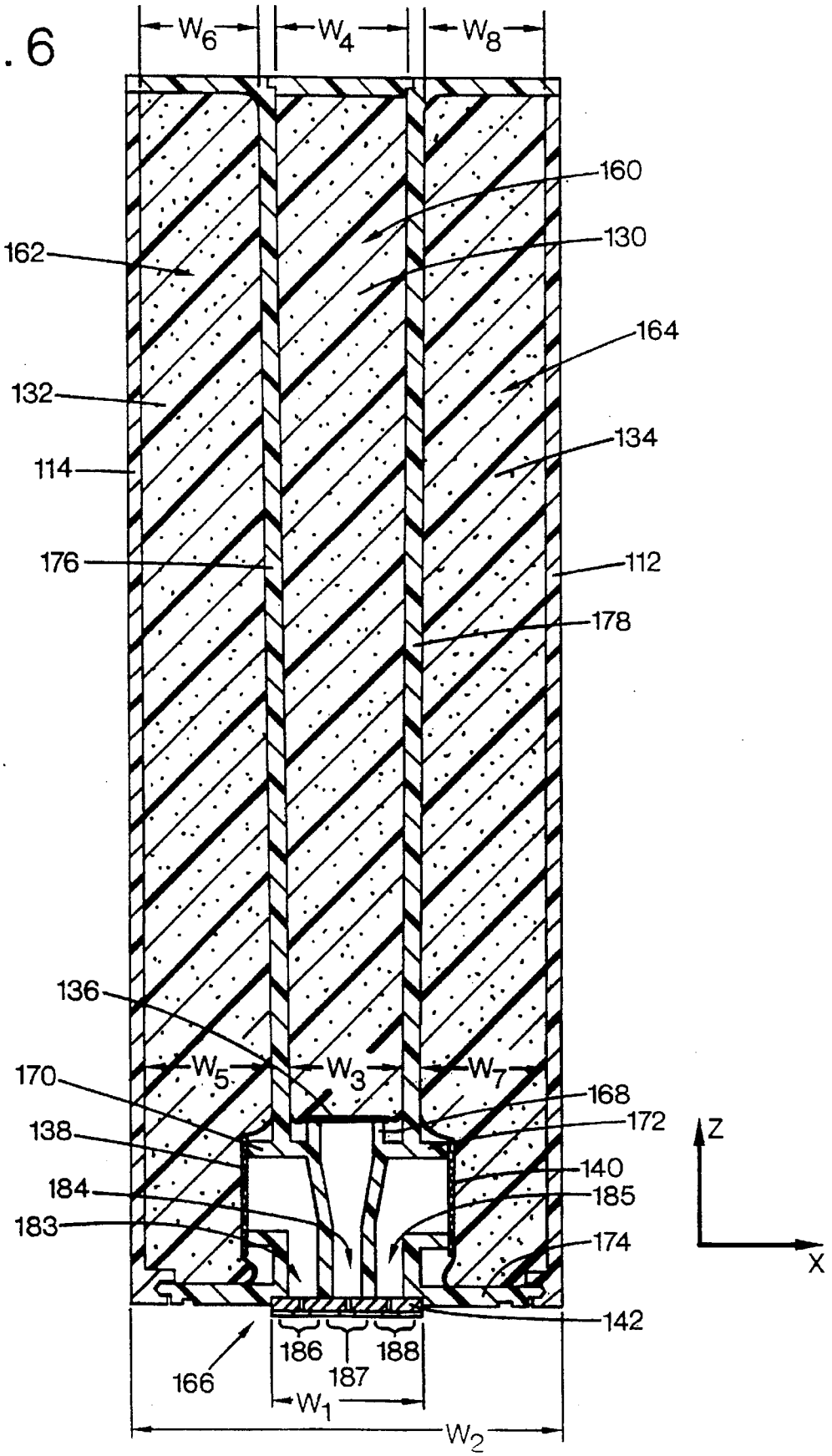
FIG. 6 is a sectional view of a portion of an assembled pen, also taken along section line 5—5 of FIG. 3 as viewed to the left in FIG. 3.
Figure 7:
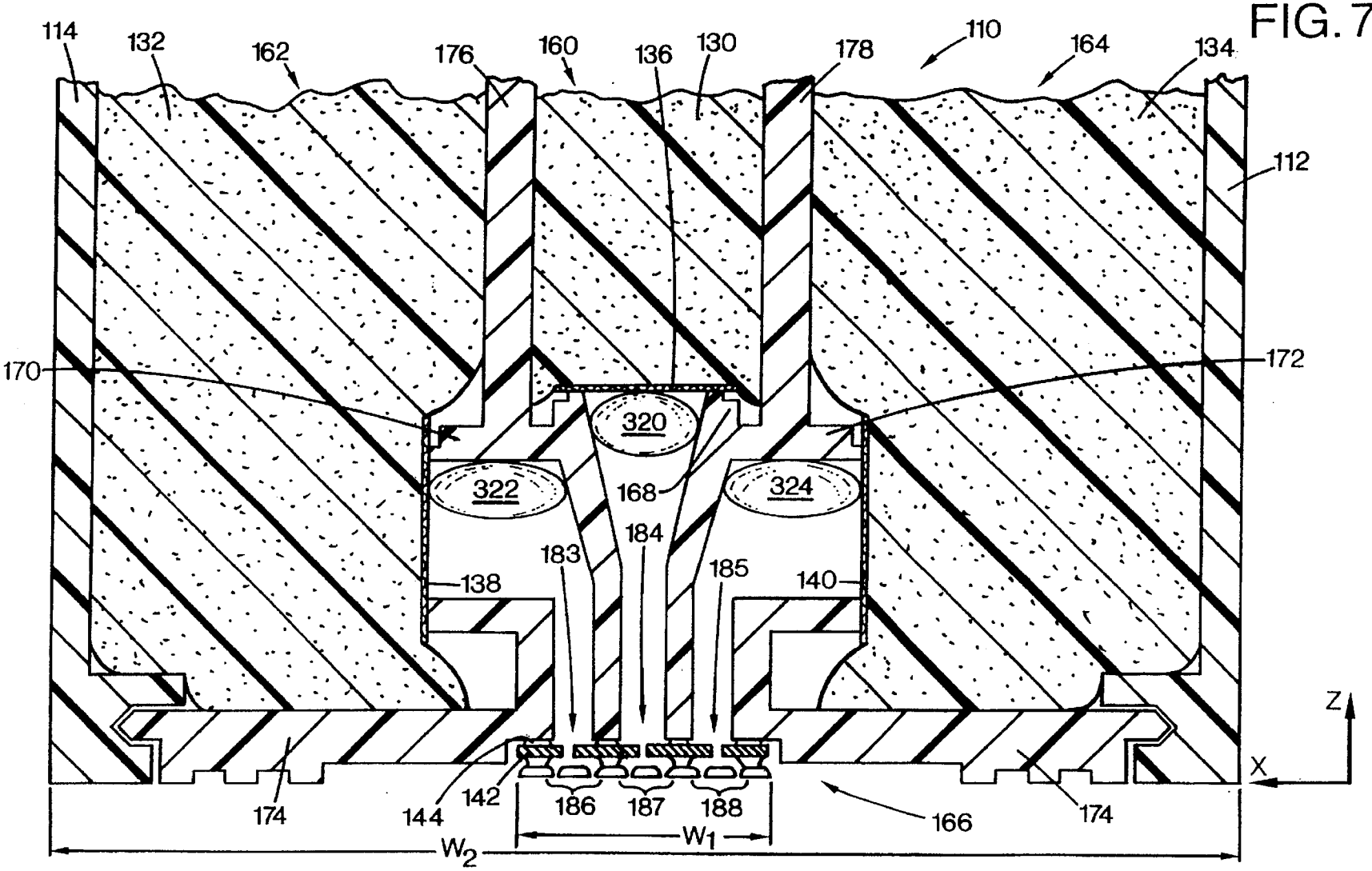
FIG. 7 is a partial sectional view of a portion of an assembled pen, also taken along section line 5—5 of FIG. 3 as viewed to the left in FIG. 3.

As shown in FIGS. 6 and 7, manifold 166 includes a center ink pipe 168 and two side ink pipes 170 and 172. Ink pipe 168 extends upward from bottom wall 174 and ink pipes 170 and 172 extend outward from sidewalls 176 and 178. Ink pipes 168, 170 and 172 form ink inlets to receive ink from their respective ink chambers. These ink pipes have rectangular cross sections with dimensions of 9.6 mm by 4.5 mm, and thus have internal cross-sectional areas of 43.2 $mm^2$. Filter 136, which is formed of stainless steel wire mesh is heat staked to center ink pipe 168, as shown. Similarly, stainless steel wire mesh filters 138 and 140 are heat staked to side ink pipes 170 and 172, as shown. These filters have the same effective filtering area as the ink pipes to which they are attached, i.e., 43.2 $mm^2$. They have a nominal filtration capability of about 15 microns and a thickness of about 0.15 mm.

These filters preclude debris and air bubbles from passing from the foam into the ink pipes. They also provide an important function in preventing spiked surges of ink through the filter. The spaces between the wire strands act as fluid restrictors, which resist fluid flow based on an exponential relationship to the velocity of fluid passing through the filter. Thus, if ink is traveling slowly through the filters, for example during printing, nominal resistance is met at the filter. Without the filter, if the pen were to be jarred, for example, by being dropped, any surges in the ink could easily cause air to be gulped into the firing chambers of the printhead, causing these chambers to deprime. However, with the filter in place, rapid fluid flow through the filters is largely prohibited, so that gulping does not occur.

Center foam member 130 is inserted into center chamber 160 from the Z direction to be compressed by center ink pipe 168 and filter 136. Center foam member 130 compresses down over and extends around the perimeter of ink pipe 168 and filter 136, as shown. This compression and overlap of foam member 130 around the perimeter of ink pipe 168 and filter 136, because of frictional engagement, greatly inhibits any motion of foam member 130 in any direction normal to the Z direction. Similarly, foam member 132 is inserted into side ink chamber 162 from the X direction shown in FIG. 6 to be compressed by and to conform around the perimeter of side ink pipe 170 and filter 138. Foam member 134 is inserted into ink chamber 164 from the X direction to be compressed by and to conform around the perimeter of ink pipe 172 and filter 140, as shown. The compression of foam members 132 and 134 by their respective ink pipes and filters and their frictional engagement of the perimeter of the ink pipes and filters greatly inhibits any motion of foam members 132 and 134 in any direction normal to the X direction.

The compression of foam members 130, 132, and 134 by their respective ink pipes and filter increases the capillarity of the foam members in the region of their respective ink pipes and filters. This capillarity increase causes ink to be attracted toward the ink pipes 168, 170, and 172. From these conduits, the ink is fed to the back side of printhead 142 from which it can be jetted onto the print medium according to signals received from the printer.

Printhead 142 is formed on a substrate from an electronics grade silicon wafer. The resistors, conductors, ink channel architecture, and other printhead components are formed on the substrate using photolithographic techniques similar to those used in making integrated circuits. Printhead 142 is a face-shooter design, which means that the ink is fed to the substrate from a position behind the substrate, and the droplets are ejected normal to the substrate surface. Because the ink is fed to the back side of the printhead, the natural orientation of the ink pipe in face-shooter printheads is normal to and pointing away from the print medium and orthogonal to the scanning direction. One advantage of bringing the ink to the printhead surface from the back side is that the ink contact with the printhead can act as a heat sink to remove heat from the printhead as printing progresses.

As can be seen, the width W1 of the printhead 142 is significantly smaller than the width W2 of the entire pen. As has been stated, minimizing the size of the printhead is important in minimizing the overall cost of the pen because of the relatively expensive components in the printhead. It is also apparent in FIG. 6 that the only ink-to-ink interface between inks of different colors occurs at the back side of the printhead 142. Specifically, adhesive layer 144 keeps the inks of different colors apart. Thus, even though pen 24 carries a relatively large volume of ink and has a relatively small printhead, the manifold feature 166 allows the printhead to have only one ink-to-ink interface. In other words, there are no seams or other connections at other positions in the printhead where ink of one color might leak into a chamber dedicated to another color. This beneficial feature of having only one ink-to-ink interface is accomplished because of the novel manifold 166 being formed as part of the main body member 110. Thus, an ink-to-ink interface is eliminated as compared to previous-generation multi-color HP pens, in which the region of attachment of the ink chamber cover member provided an additional ink-to-ink interface, with the inherent risk of ink mixing.

The center chamber 160 is defined by the space between sidewalls 176 and 178 and extending upwardly from bottom wall 174. The side chambers 162 and 164 are defined to be on the outside of sidewalls 176 and 178 respectively. Ink pipe 168 extends upwardly from bottom wall 174 and into compressive contact with the center foam member 130. Inward walls 176 and 178 extend upwardly from bottom wall 174. Ink pipes 170 and 172 extend outwardly from inward walls 176 and 178, respectively, and into compressive contact with the respective foam members 132 and 134, as shown. Manifold 166 has three ink outlets, 183, 184, and 185. Printhead 142 has three groups of nozzles, 186, 187, and 188. As can be seen, center ink pipe 168 fluidically communicates with center ink outlet 184, and thus with the center group of nozzles 187. Side ink pipe 170 fluidically communicates with ink outlet 183 and hence with nozzle group 186. Side ink pipe 172 fluidically communicates with outlet 185 and hence with nozzle group 188.

It is important that ink pipes 168, 170, 172 extend into compressive contact with the foam to increase the capillarity of the foam in the region of the ink pipes. The filters 136, 138, and 140 also serve an important role in assisting in this compression. In the previous-generation pens produced by the assignee of the present invention, discussed above, these ink pipes extend upwardly, all in the same direction, from a bottom wall of the pen. These ink pipes are all oriented in the same direction, upwardly and away from the bottom wall of the pen. However, in the illustrated pen of the present invention, only one of the ink pipes, ink pipe 168, extends upwardly away from the bottom wall 174. The other two ink pipes, 170 and 172 extend outwardly into their respective ink chambers.

The dimensions of the pen 24 are given in Table 1, below. These dimensions are given for the main ink cavity portion 124 and ignoring the nose portion 126 (FIG. 3). For the portions of pen 24 described, the width is taken along X axis, length is taken along the Y axis, and height is taken along the Z axis. As shown in FIG. 6, center chamber 160 has a bottom width W3 and a top width W4. Chambers 162,164 have bottom widths W5, W7 and top widths W6, W8 respectively. All dimensions are given in millimeters except where indicated.

TABLE 1

Pen 24 Dimensions

| | Bottom Width | Top Width | Bottom Length | Top Length | Height | Volume (cc's) |
|---|---|---|---|---|---|---|
| Center Chamber 160 | 8.05 | 10.29 | 56.64 | 57.73 | 68.07 | 35.71 |
| Side Chambers 162 and 164 | 9.83 | 8.64 | 55.75 | 55.75 | 70.01 | 36.04 |

The following Table 2 compares the height of the three ink chambers 160, 162, 164 against their respective widths. Since the three chambers each have differing widths along their height, the height/width comparisons are made for the bottom width, top width, and average width of each chamber.

TABLE 2

Pen 24 Dimension Ratios

| | height/width ratios | | | length/width ratios | | |
|---|---|---|---|---|---|---|
| | bottom | top | average | bottom | top | average |
| Center chamber 160 | 8.46 | 6.62 | 7.42 | 7.03 | 5.61 | 6.24 |
| Side Chambers 162 and 164 | 7.12 | 8.10 | 7.58 | 5.67 | 6.45 | 6.04 |

Thus the height/width ratios are all at least 6, with most of them at least 7. They range from about 6½ to about 8½. The height/width ratios using the average widths of the chambers are all at least 7, and are close to about 7½. The length/width ratios are all at least 5. They range from about 5½ to about 7. The length/width ratios using the average widths of the chambers are all in about the 6 to 6¼ range.

The dimensions and dimension ratios of the chambers of pens 24 can be compared to corresponding values of previous-generation pens produced by Hewlett-Packard Company, the assignee of the present invention. The following Table 3 gives the dimensions and key dimension ratios of previous generation HP pens, as identified by their commonly known and widely used model numbers.

TABLE 3

Previous-Generation HP Pens

| | Cavity Size | | | Cavity Ratios | |
|---|---|---|---|---|---|
| Pen Type | width | height | length | ht/wid | ln/wid |
| 51606A (PaintJet black) | 22.6 | 32.8 | 31.4 | 1.45 | 1.39 |
| 51606A (PaintJet color) | 6.8 | 33.0 | 32.8 | 4.89 | 4.86 |
| 51608A (DeskJet black) | 25.3 | 41.2 | 34.3 | 1.66 | 1.36 |
| 51625A (DeskJet color) | 14.2 | 42.0 | 25.6 | 2.96 | 1.80 |

As can be seen in Table 3, DeskJet 51608A color pens have a height/width ratio 2.96 and the length/width ratio is 1.80. A question that must be resolved, however, is what is the "width" of the chambers in the 51625A DeskJet color pen. For the purposes of the above tables, the narrowest dimension, which is in the media-advance direction, is selected as the width dimension. If the dimension along the scanning direction (when the pen is installed in the printer) is chosen as the width, then the width and length measurements would be interchanged in the above tables. The chambers in the 51625A color pens are narrower in the paper-advance direction because they are transversely oriented, or arranged side by side in the paper-advance direction, rather than in the scanning direction. This transverse orientation creates the need for a complicated manifold to duct the ink from the ink chambers to the printhead. This manifold must be formed as a separate part and attached, e.g., by adhesive or ultrasonic weld to the bottom of the pen. The manifold thereby introduces undesirable additional ink-to-ink interfaces between inks of different colors at locations where pen parts are attached to each other.

Paintjet 51606A color pens have a height/width ratio of 4.89 and a length/width ratio of 4.86 . Thus, the PaintJet color pen chambers have close to a square cross section as viewed from the side, and may be considered as having a narrow aspect ratio. PaintJet color pens avoid the problem of multiple ink-to-ink interfaces between pen body parts in the region of the printhead. However, these pens have the undesirable trait of having a very wide printhead. This wide printhead is expensive and also places the nozzles groups corresponding to the three colors farther apart than is deskable for improved print quality.

It is significant to note that the height/width ratio of the pen 24 chambers are between 35 to 73% greater than the height/width ratio of the PaintJet color chambers. In terms of absolute height, the height of the pen 24 chambers is about 70 mm (excluding the nose portion 126); whereas the height of the PaintJet color chambers is just 33 mm. Therefore, the pen 24 chambers are more than twice as tall as the PaintJet color pen chambers.

Previous HP foam-based pens have the ink pipe extending upward into the foam from a bottom interior wall of the pen. This upward orientation, normal to the printhead surface and to the print medium is the natural orientation for the ink pipe in face-shooter pens. However, because of the absolute height of pen 24 and its height/width aspect ratio, loading the foam into the ink chambers from the top would be difficult without introducing wrinkling or other anomalies in the foam that cause stranding of ink.

Pen 24 also has narrow aspect ratio ink chambers, since it has both a height/width or length/width ratios of 4 or more. Even though the ink chambers in pen 24 have narrow aspect ratio ranges as indicated in Table 2, the foam members are loaded into their respective chambers 160, 162, and 164 without introducing the above-mentioned problems associated with narrow aspect ratio ink chambers. This is true because of various factors. First, the foam members are highly felted, which provides these foam members enhanced stiffness. In addition, the foam members are felted to have final dimensions close to the interior cavity dimensions of their respective chambers. (Felting is discussed more completely in reference to FIGS. 9 and 10.) In center chamber 160, which must be loaded top down, the chamber has a greater width near its top than near its bottom, so that the walls of the chamber increasingly compress the foam as it is loaded.

Finally, the outer chambers 162 and 164 of pen 24 open to the side, rather than from the top, and the foam members 132 and 134 are loaded from the outward side. This produces the result that foam members 132 and 134 only need to be loaded over a very small distance (about 9 mm) into the pen body before they in compressive contact with their ink pipes. Therefore, problems related to foam insertion, such as ink stranding and uncertain contact with the ink pipe, are minimized. In addition, assembly costs are reduced, because there is no need for specialized tools to insert the foam into the pen body. The foam can be fairly simply inserted into the outer chambers.

An important issue that must be considered is the molding process that must be used to form the pen body parts. Ink-jet pen bodies are typically formed of injection molded plastic. The chambers of the previous generation HP foam-based pens have their ink pipes extending upward from the bottom of the chambers and are formed to have the foam inserted from openings from the top of the chambers. These chambers are therefore formed as deep interior cavities. To form such a deep cavity, a molding part must extend deeply into the plastic part being molded. In the case of three-chambered pens, there must be three such mold parts closely spaced side by side. After the plastic is injected into the mold and around the molding parts to form the pen body, the deep mold sections must be removed from the ink chambers. The greater the height/width and/or length/width ratios are, the more difficult it is to remove these mold sections without damaging the molded part. If all three of the chambers in pen 24 were formed as deep cavities so that the foam was inserted from the top down, the molding assembly would be very difficult to design, if indeed possible at all, because of the difficulty in removing interior molding parts from three such deep, side-by-side chambers.

Center chamber 160 is formed as a deep cavity. However, the problems with such deep chambers are solved to some degree in the center chamber by forming the center chamber to have an increasing width from the bottom toward the top. Since the exterior of the pen has a generally rectangular shape, the outside chambers must therefore have a decreasing width from the bottom toward the top. Thus, it is feasible to have one chamber (the center chamber) have such an increasing width, but it would not be feasible to have all three chambers have such an increasing width, unless the pen had a non-rectangular outer form factor, or if the walls of the pen were of non-uniform wall thickness. Either of these alternatives are undesirable.

Figure 8:
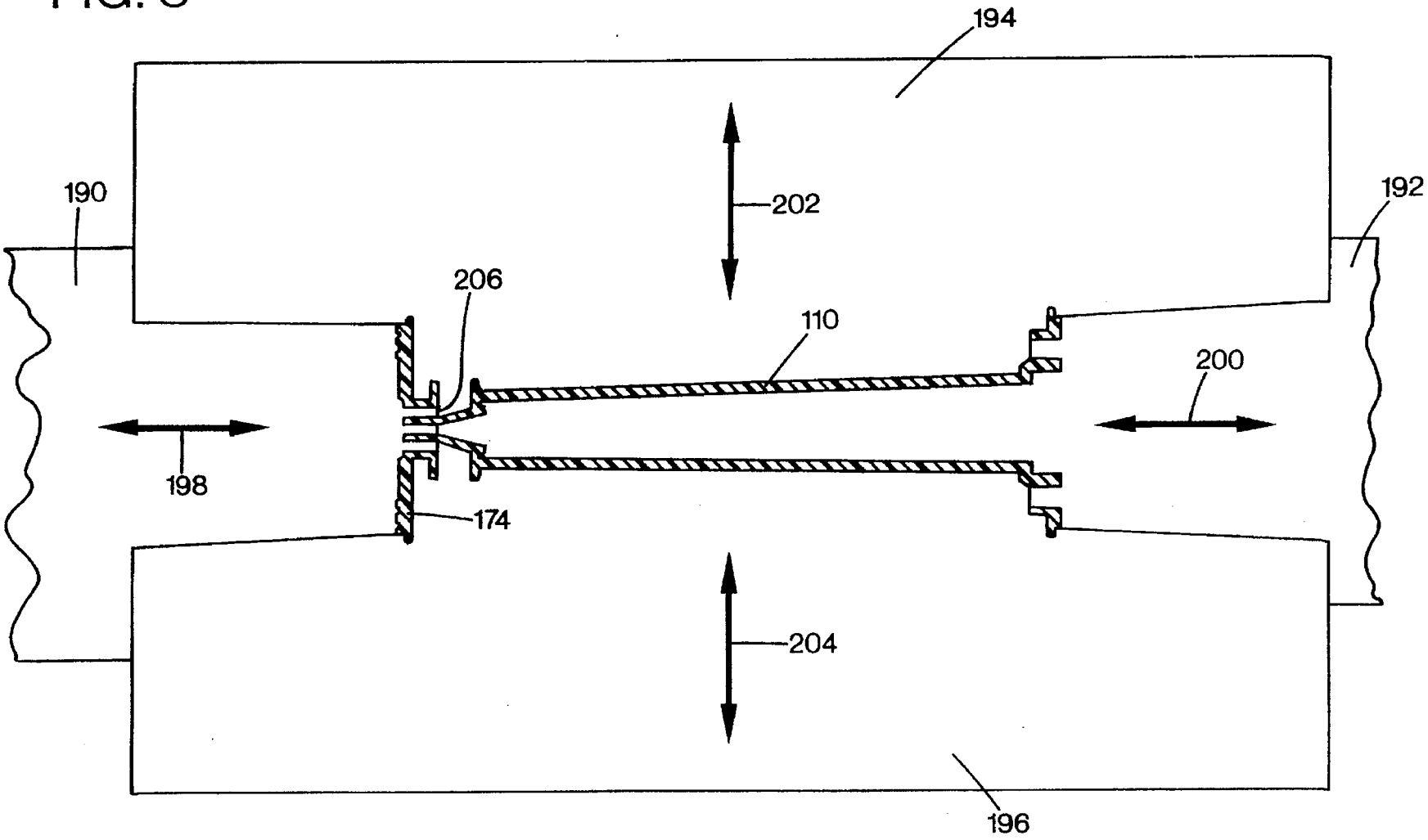
FIG. 8 is a sectional view of a molding assembly for the main body member 110.

FIG. 8 illustrates the molding process used to form center body member 110. Center body member 110, as with other portions of the pen body, is made of glass filled PET (polyester) with a 15% glass fill. Main body member 110 is formed in an injection molded process. The molding assembly illustrated in FIG. 8 includes four sections: section 190, section 192, section 194, and section 196. Sections 190 and 192 slide to the right and left as shown in FIG. 8 as indicated by arrows 198 and 200. Sections 194 and 196 slide up and down as viewed in FIG. 8 as indicated by arrows 202 and 204. A critical "shut-off" occurs at position 206. A shut-off is an area where two or more sections of a mold mate together with the intention of excluding plastic from the mating region. Shut-off 206 is the position at which sections 192, 194 and 196 meet with section 190.

It is an important goal in designing plastic molds to maintain a uniform wall thickness of molded wall parts. As can be seen in FIGS. 5, 6, 7, and 8, this objective has been for the most part obtained in the main body member 110. Another important consideration in molding processes is that the deeper an internal mold section, such as section 192, extends into the plastic part being molded, the more difficult it is to withdraw from the molded part without damaging it. As can be seen, section 192 extends deeply into the main body member 110 and terminates at the shut-off 206. To aid in the removal of section 192 after main body member 110 has been injection molded, section 192 has an increasing width as it extends from the left toward the right. Hence, the center ink chamber 160 is narrower closer to shut off 206 than at positions extending away from shut off 206. Since pen 24 is generally rectangular in cross section, this means that the outer chambers 162 and 164 have a decreasing width as they extend away from the bottom wall 174.

Before foam body members 130, 132, and 134 are inserted into pen 24, they must be "felted." As stated, foam body members 130, 132, and 134 are preferably formed of reticulated polyurethane foam. Felting is a process in which foam is subjected simultaneously to heat and compression, which causes the foam to take a set and retain its compressed state. The felting process is described in reference to FIGS. 9 and 10. Before felting, the foam has an average pore size of 85–90 pores per inch, a density of about 1.3 lbs. per cubic foot, and a thickness of about 2.3 inches.

Figure 9:
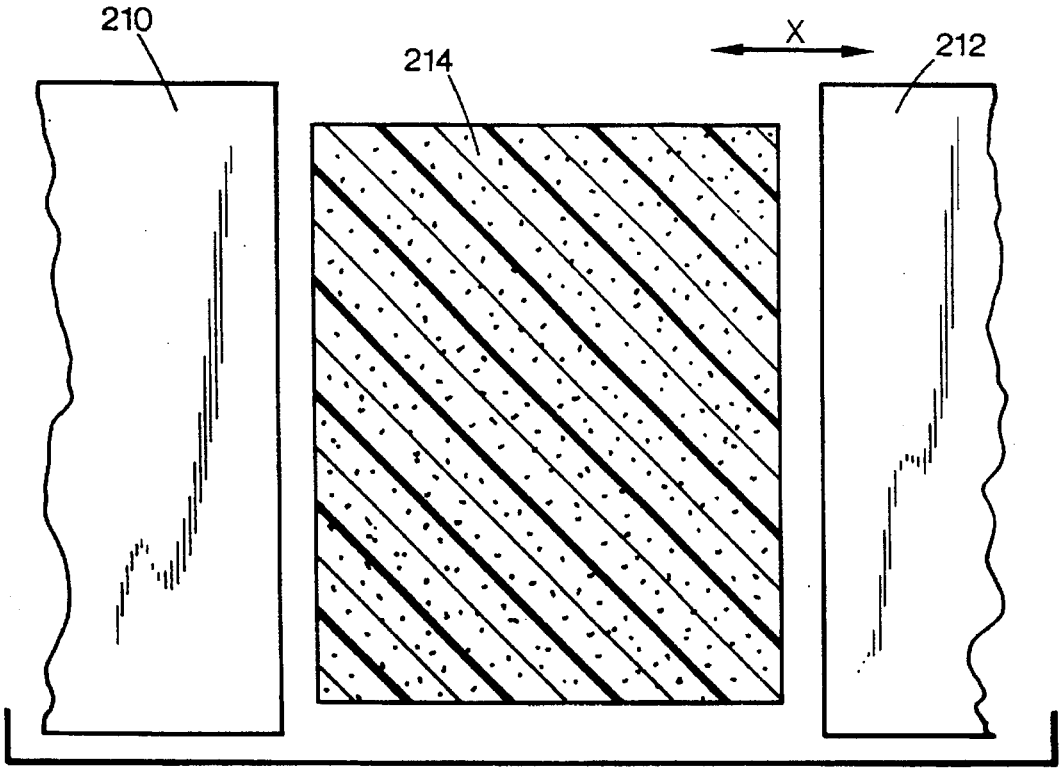
FIGS. 9 and 10 are side views of a felting mechanism.
Figure 10:
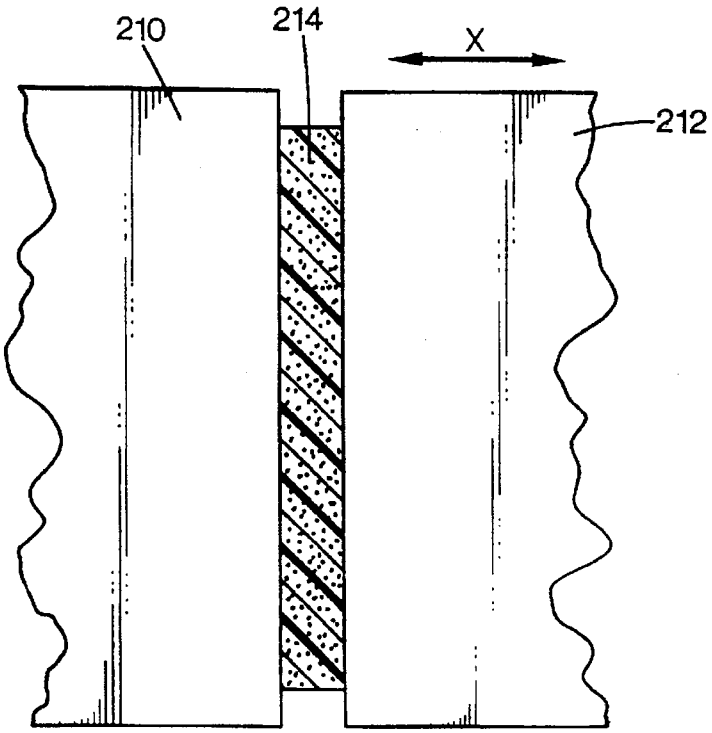

In FIG. 9, two felting presses 210 and 212 are used to felt a reticulated polyurethane foam member 214. As shown in FIG. 10, the felting presses 210 and 212 are brought closer together to compress foam member 214. At the same time, heat is applied through felting presses 210 and 212, which causes the internal structure of foam member 214 to take a set and to retain its compressed configuration shown in FIG. 9. The foam is felted at 360° F. for 35 minutes. After felting, the foam has a thickness of about 0.42 inches. Thus, as compared to their uncompressed state as shown in FIG. 9, the foam body members 130, 132, and 134 are felted a total of 548% before insertion into the pen body. Stated another way, the foam is felted to about 18% of its pre-felted state. The foam used in pen 24 has a significantly higher felting than previous-generation HP pens.

A large slab of foam is felted, and the foam members are cut from this slab. Foam members may be either cut with saws or die stamped. Die stamping is preferred because it is more efficient and less expensive. Felting makes the foam bodies much easier to die stamp because the felted foam is stiffer and resists rolling around the edges during the stamping process. If the foam is not felted, it is not as stiff, and the edges roll excessively during the stamping process. Even if the foam body is felted and die stamped, it is preferable to do a finishing step of sawing certain edges of the foam body to make them more square, particularly the edges parallel to the Z axis as shown in FIG. 4, such as edges 218, 220, 222, and the other vertical edge not shown.

A benefit of the felting process is that it aids in the insertion of the foam members into the pen body. This is particularly true of the center foam member 130. The felting process makes the foam more stiff in the Z direction as viewed in FIGS. 4 and 6. The center chamber 160 is particularly long and narrow. It is difficult to insert a foam member in such a long narrow chamber. However, the stiffness of the foam after being felted allows the foam member to be more easily inserted in to the center chamber and reduces the likelihood that wrinkles or non-uniformities occur in the foam. It is extremely important to avoid such non-uniformities, because at each position where the foam has localized high compression, the foam at these positions will have a slightly higher capillarity and will cause a certain amount of ink to be stranded at these locations in the foam.

Additionally, this stiffness helps in maintaining a positive compression and seal between ink pipe 168 and foam member 130. Foam members 132 and 134 are much more easily inserted into the side chambers 162 and 164. But even in this orientation the additional stiffness achieved by the felting process helps in keeping the foam bodies 132 and 134 in compressive contact with ink pipes 170 and 172. For the foam in all three chambers, the felting axis or direction is in the same, and is the direction in which the felting presses 210 and 212 move during the felting process, which is the X direction as shown in FIGS. 9 and 10.

As stated, the center chamber 160 is wider near its top than near its bottom, or closer to the bottom wall 174. The center foam member 130 after felting is about the width of the center chamber near its top. Therefore, the center foam member 130 is additionally compressed by inward walls 176 and 178 as the center foam member is inserted into center chamber 160.

Loading of the foam in the center chamber is improved over previous generation pens because of the "near net" size of the foam slabs used in pen 24. The volumes of the ink chamber cavities as compared to the volume of the foam prior to insertion is set forth in the following Table 4.

TABLE 4

| Volume Comparisons (cc's) | | | |
|---|---|---|---|
| Pen Type | Cavity | Foam | Foam/Cavity Ratio |
| 51606A (PaintJet black) | 23.28 | 35.28 | 1.51 |
| 51606A (PaintJet color) | 7.36 | 10.98 | 1.49 |
| 51608A (DeskJet black) | 36.53 | 67.69 | 1.85 |
| 51625A (DeskJet color) | 15.27 | 23.99 | 1.57 |
| Center Chamber 160 | 35.71 | 45.13 | 1.26 |
| Side Chambers 162, 164 | 36.04 | 44.18 | 1.23 |

Thus in the previous generation HP foam-based pens, the foam/cavity volume ratios are on the order of about 1.5 or greater. This means that the overall volume of foam before insertion into the chambers was at least 50% greater than the actual volume of the chamber into which the foam was inserted. This requires that the foam be squeezed into the chambers during the insertion process. This squeezing requires additional machinery to insert the foam into the chambers while it is compressed by some means.

Before the development of the present invention, it was believed that this extra pre-insertion volume of foam was necessary to achieve proper compressive contact between the foam, the interior walls of the pen, and the ink pipe. However, because of the increased felting of the foam members in pen 24, which adds significant amounts of stiffness, the foam members can be closer to the cavity volume before insertion into the cavity. As shown in Table 3, the foam members of pen 24 have a pre-insertion volume that is between 1.23 to 1.26 times the cavity volume. The foam members thus have a pre-insertion volume that is about 125% of the cavity volume, which in effect becomes the post-insertion volume. A pre-insertion volume that is less than 130% of its post-insertion volume is preferable, and a pre-insertion volume about 125% is highly preferable. A pre-insertion volume less than 130% of the post-insertion volume is considered to be "near net size."

Figure 11:
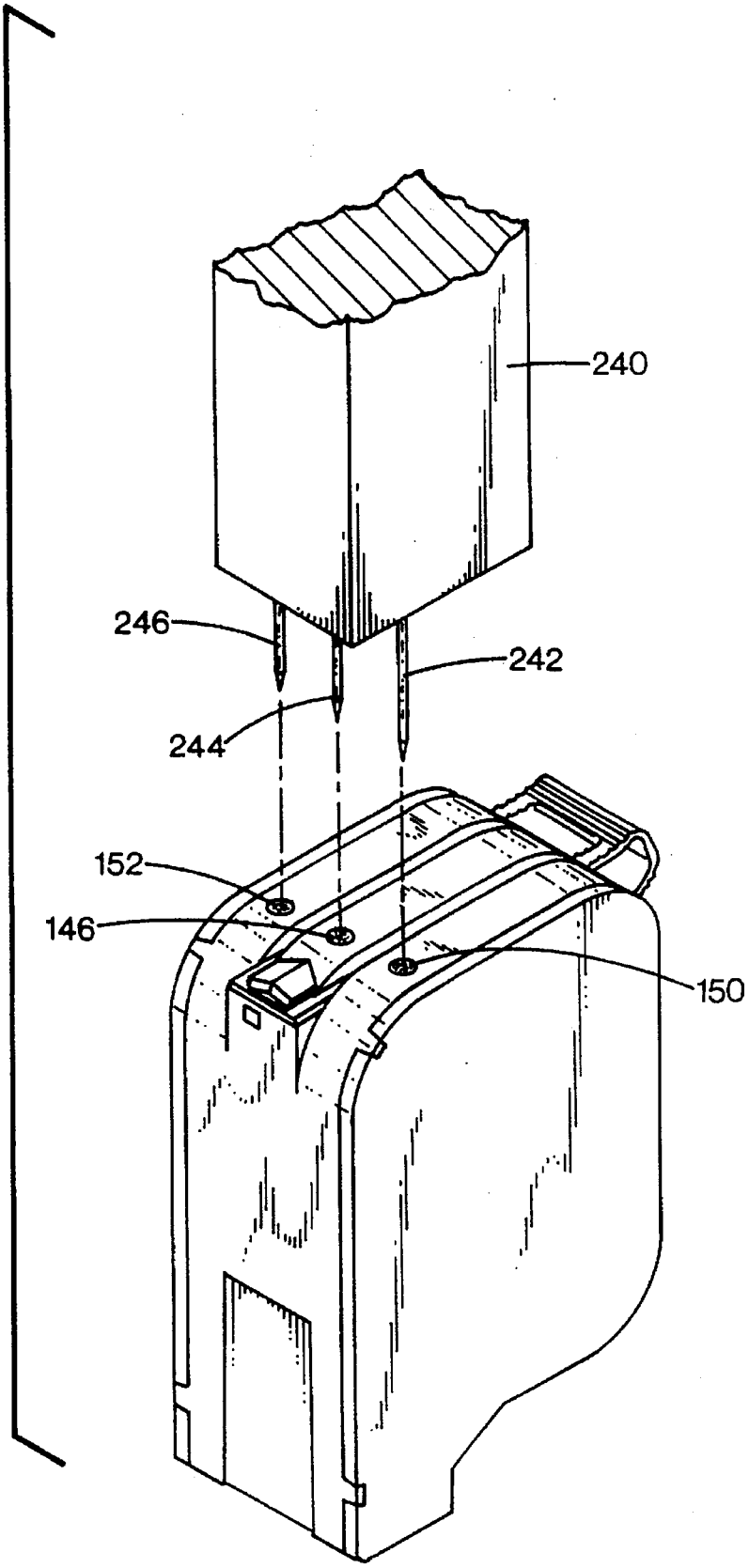
FIG. 11 is a perspective view of a filling mechanism.

FIG. 11 illustrates how pen 24 is filled. Filling member 240 contains three separate supplies of in that are attached respectively to three syringes 242, 244, and 246. These syringes are designed to be inserted into holes 148, 154 and 156 (FIG. 4). After filling, plugs 146, 150, and 152 are pressed into the respective holes.

Another advantage of having the outer ink pipes 170 and 174 oriented to one side or horizontally is illustrated in FIG. 7. As shown, a large air bubble 320 is formed in ink pipe 168, bubble 322 is formed in ink pipe 170 and bubble 324 is formed in ink pipe 172. These bubbles are formed of air that has come out of solution in the ink and/or ingested by the printhead. Printhead 142 contains thermal resistors that are activated to rapidly boil ink during printing. Therefore printhead 142 and ink adjacent to printhead 142 tend to warm up during printing. As the ink adjacent to the printhead heats up, dissolved air in the ink tends to come out of solution and to collect at the top of the ink pipes in bubbles, as shown. Bubbles 322 and 324 rise to the top of their respective ink pipes. Because these ink pipes are oriented horizontally, with the filters 138 and 140 vertical, there is space under the bubbles for ink to pass from the foam and through the ink pipes into the printhead. Thus, horizontal ink pipes provide for improved ink flow in the presence of bubbles.

Even if the bubble were to grow large enough to extend across the entire vertical height of the ink pipes 172 and 174, rectangular cross sections of theses ink pipes provide four corners that form capillary ink paths around the bubble. Bubbles tend to form in a spheroid shape and do not easily extend into corners. The rectangular ink pipes are especially advantageous in the center ink pipe 168. Because ink pipe 168 is vertically oriented when the pen 24 is used in the orientation shown, and has a horizontal filter 136, bubble 320 tends to cover a larger portion of its respective filter than do bubbles 322 and 324. However, because ink pipe 168 has a square cross section, a capillary ink flow path is provided in the four corners of ink pipe 168 past the bubble and downward to the printhead 142.

I claim:

1. A multi-chamber ink-jet pen comprising:

a main body member formed unitarily as a single part and including:

a bottom wall, a center chamber extending upward from said bottom wall, two side chambers mounted on either side of said center chamber and each having an inward wall positioned at least partially between a respective one of said two side chambers and said center chamber, a center ink inlet that opens into said center chamber from said bottom wall, and two side ink inlets, each of which opens into a respective one of said side chambers from said inward walls, a printhead mounted on said main body member and having three nozzle groups, each of said nozzle groups being fluidically connected to a respective one of said ink inlets; and a body of ink disposed within each of said center aid side chambers.

2. An ink-jet pen according to claim 1, further comprising a porous member disposed within said center chamber and said side chambers, said bodies of ink being held within said porous members.

3. An ink-jet pen according to claim 2 wherein said center ink inlet is an ink pipe extending upward into said center chamber and wherein each of said side ink inlets is an ink pipe extending outward into said side chambers into compressive contact with said porous members.

4. An ink-jet pen for use in an ink-jet printing system having a scanning direction and a height direction, the pen comprising:

a main body member molded as a single part and including:

a bottom wall, a center chamber extending upward in said height direction from said bottom wall and having two side walls defining the sides of said center chamber, two side chambers on either side of said center chamber in said scanning direction and each sharing in common with said center chamber one of said side walls, a center ink pipe extending upward from said bottom wall into said center chamber, a side ink pipe extending into each of said side chambers from a respective one of said side walls, and three ink outlets that open downward from said bottom wall, each of said ink outlets being fluidically connected to a respective one of said center and side ink pipes;

a printhead mounted to said bottom wall and having three nozzle groups, each of said nozzle groups being fluidically connected to a respective one of said ink outlets;

a porous member disposed within each of said center chamber and said side chambers; and a body of ink disposed within each of said porous members.

5. An ink-jet pen according to claim 4 wherein said center and side ink pipes extend into compressive contact with said porous members.

6. An ink-jet pen according to claim 4, wherein said side chambers have outer openings opposite said side ink pipes.

7. An ink-jet pen according to claim 6 wherein said center chamber has a top opening opposite said center ink pipe.

8. An ink-jet pen according to claim 7 wherein said porous members are inserted into said center and side chambers through said top and outer openings.

9. An ink-jet pen according to claim 8 further comprising a center and side cover members attached to said main body member to enclose said porous members in said main body member.

10. A method of manufacturing an ink-jet pen, the method comprising:

molding a main body member as a single part to include:

a bottom wall, a center chamber extending upward from said bottom wall and having two side walls, two side chambers on either side of said center chamber, each of said side chambers sharing one of said side walls in common with said center chamber, a center ink inlet that opens from said bottom wall into said center chamber, and a side ink inlet that opens outward in into each of said side chambers from a respective one of said side walls;

attaching a printhead to said bottom wall and fluidically connecting each of a plurality of a nozzle group on said printhead to a respective one of said ink inlets;

installing a center porous member into said center chamber;

installing a side porous member into each of said side chambers;

enclosing said center and side chambers; and filling ink into each of said center and side porous members.

11. A method according to claim 10 wherein said center ink inlet is formed to be a center ink pipe that extends into said center chamber and wherein said side ink inlets are formed to be ink pipes that extend into said side chambers.

12. A method according to claim 11 further comprising the step of locally compressing said porous members by said center and side ink pipes.

13. A process of passing ink to a face-shooter printhead of a multi-chamber ink-jet pen comprising:

filling ink into a center foam member having a localized increased compression provided by a center ink pipe extending upwardly into compressive contact with said foam member;

filling ink into side foam members, each having a localized increased compression provided by a side ink pipe, said side ink pipe extending outwardly from the direction of said center foam member into compressive contact with a respective one of said side foam members;

passing ink downwardly from said center foam member into said center ink pipe;

passing ink inwardly from said side foam members into corresponding said side ink pipes; and passing ink downwardly from said center ink pipe and each of said side ink pipes into nozzle groups of a face-shooter printhead.

14. A process according to claim 13 wherein said center and side foam members are mounted in a main body member that is molded as a single unitary part, said center and side ink pipes being formed with said main body member and said printhead being mounted to said main body member.

* * * * *